United States Patent [19]

Falke

[11] 4,045,657

[45] Aug. 30, 1977

[54] METHOD OF FACILITATING EXACT EVALUATION OR CONTROL OF THE PROCESSING OF A PRODUCT MASS, AND APPARATUS FOR CARRYING SAID METHOD INTO EFFECT

[75] Inventor: Erik Falke, Stockholm, Sweden

[73] Assignee: Svenska Tobaks Aktiebolaget, Sweden

[21] Appl. No.: 645,329

[22] Filed: Dec. 30, 1975

Related U.S. Application Data

[63] Continuation-in-part of Ser. No. 476,262, June 4, 1975, abandoned.

[30] Foreign Application Priority Data

June 7, 1973 Sweden ..... 7308021

[51] Int. Cl.[2] ..... G06F 15/46; A24B 9/00

[52] U.S. Cl. ..... 235/151.1; 235/151.33; 131/135; 131/138; 131/22 R

[58] Field of Search ..... 235/151.1, 151.13, 151.33; 131/22, 135, 138, 140

[56] References Cited

U.S. PATENT DOCUMENTS

| | | | |
|---|---|---|---|
| 2,768,629 | 10/1956 | Maul | 131/135 |
| 3,419,015 | 12/1968 | Wochnowski | 131/135 |
| 3,429,317 | 2/1969 | Koch et al. | 131/140 |
| 3,636,327 | 1/1972 | Troutman | 235/151.33 |
| 3,794,049 | 2/1974 | Wochnowski | 131/135 |
| 3,807,415 | 4/1974 | Elsner et al. | 131/22 R |
| 3,831,610 | 8/1974 | Wochnowski et al. | 131/135 |
| 3,948,277 | 4/1976 | Wochnowski et al. | 131/135 |

*Primary Examiner*—Felix D. Gruber
*Attorney, Agent, or Firm*—Bucknam and Archer

[57] ABSTRACT

This invention relates to a method of evaluating processing of a product mass, such as a tobacco leaf mass, by measuring the weight of the mass as throughflow per unit of time during transport of the mass between two locations and by measuring, in a point at or close to the weight measuring point, the actual moisture content of the mass, transmitting weight and moisture signals to a computer for evaluating required addition of material, such as moisture and sauce, to the mass and controlling a processing station for adjusted addition of said material to a predetermined value for the mass.

11 Claims, 7 Drawing Figures

Figure 1:
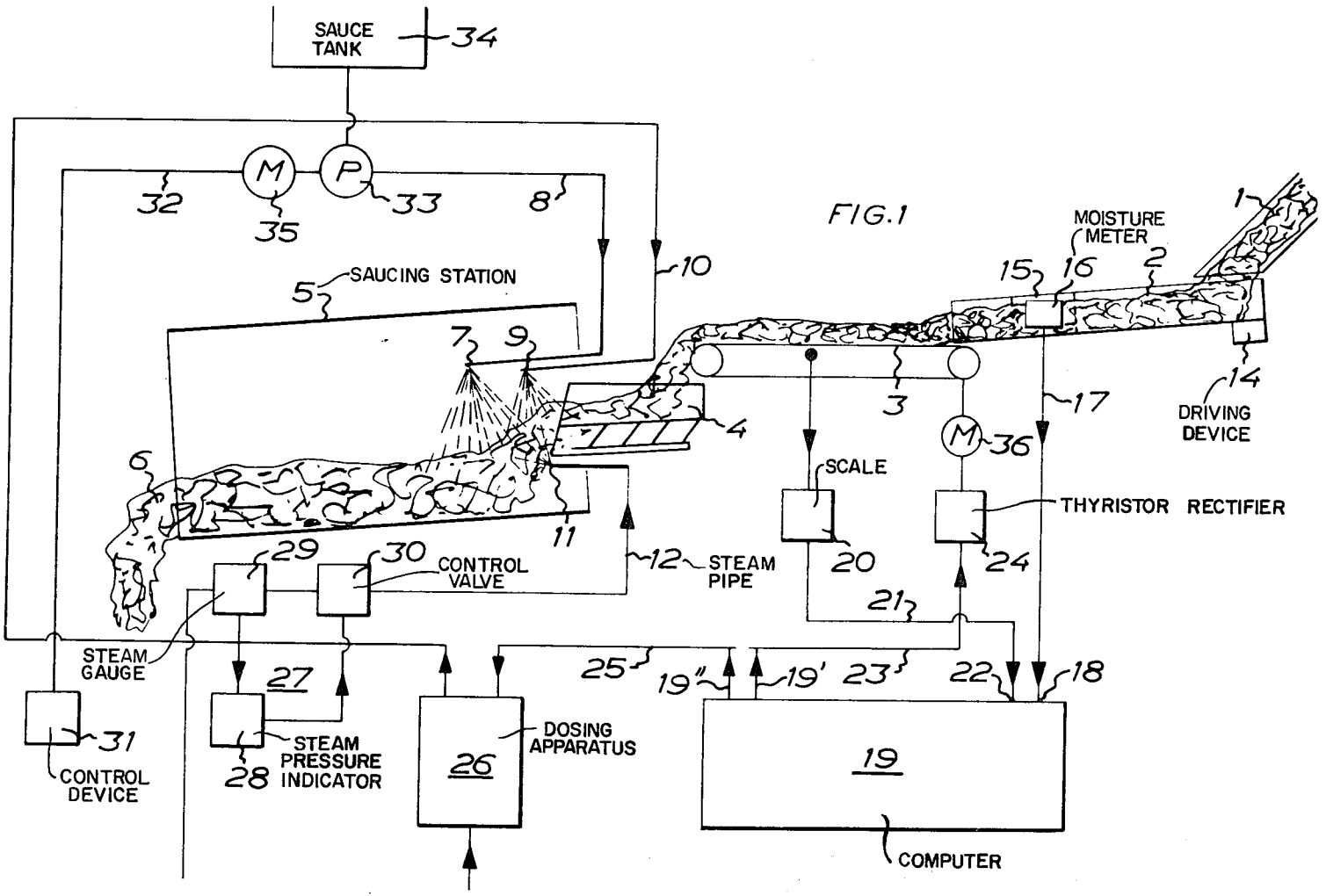

METHOD OF FACILITATING EXACT EVALUATION OR CONTROL OF THE PROCESSING OF A PRODUCT MASS, AND APPARATUS FOR CARRYING SAID METHOD INTO EFFECT

This application is a continuation-in part of my copending application Ser. No. 476,262, filed on June 4, 1974, and now abandoned.

The present invention relates to a method for the exact evaluation or control of the processing of a product mass, especially but not exclusively a tobacco leaf mass for use in the manufacture of tobacco products.

It is already known, in the manufacture of tobacco products, to measure the flow of tobacco leaf which is conveyed from a supply to and through a saucing station by causing the leaf to pass a belt weigher on which the through-flow is measured as the weight per unit of time, and using the measuring signal as a control signal for controlling the addition of sauce to the leaf in the saucing station, said control occurring with a delay conditioned by the distance between the measuring point and the saucing station. The addition of sauce is so adjusted that the quotient between the unit of weight of sauce and the unit of weight of leaf (tobacco) is maintained constant.

The sauce added at the saucing station is made up in accordance with a definite recipe for the particular tobacco product to be manufactured and may be considered to have a certain constant moisture content which is known. It is important that the amount of sauce in the tobacco (the quotient sauce weight/tobacco weight) is maintained as constant as possible in order to achieve an unvarying product quality, and it has therefore been endeavoured to maintain the moisture content of the tobacco as constant as possible and to achieve an increasingly refined control technique for the addition of sauce. Although today's technique gives excellent results, it would seem as if developments have reached a limit beyond which it is difficult to go, in spite of the fact that further improvements are still desirable.

The invention has for its object to make possible a still further improved control technique which pays full regard to a previously neglected but highly important factor, i.e. the varying moisture content of the tobacco.

To measure the actual value of the moisture content of the leaf, the present invention utilises a continuously operating moisture meter from which a measuring signal is supplied to a computer together with a measuring signal which indicates the throughflow weight of the leaf per unit of time. The computer establishes the solids content of the leaf and provides, as the output signal, a control signal for controlling a processing operation, such as the addition of sauce to a mass of tobacco leaf. A highly exact dosage of sauce can be obtained by basing the quotient sauce weight/mass weight upon the sauce weight/dry weight of mass, but it is also possible to base the dosage upon the weight of the mass wwhich has an ideal moisture content in that the moisture content can be adjusted, on the basis of the computed result, to a predetermined moisture content before or in connection with the saucing. Adjustment can be effected by controlling a conveyor, for instance a belt weigher, on which the throughflow of the mass is measured, the throughflow of the mass being adjusted to a set desired value for the solids content. The sauce which is considered to have a constant moisture content, is added in proportion to the desired value of the solids mass so that the quotient unit of weight of sauce per unit of weight of solids will remain constant. The computer also establishes the difference in moisture content between the input mass plus the sauce moisture content (which is constant) and the desired value of the desired output moisture content, the output signal from the computer being used for adjusting the added amount of water to a desired value of the output moisture content, set by means of the computer.

By calculating the solids weight, this weight may thus be used as a basis for the addition of moisture and sauce. The supply of mass to the processing station is controlled by means of a conveyor, for instance a belt weigher, and/or by adjusting the amount of moisture and sauce supplied.

The invention also comprises an apparatus for carrying the above-mentioned method into effect.

Figure 2:
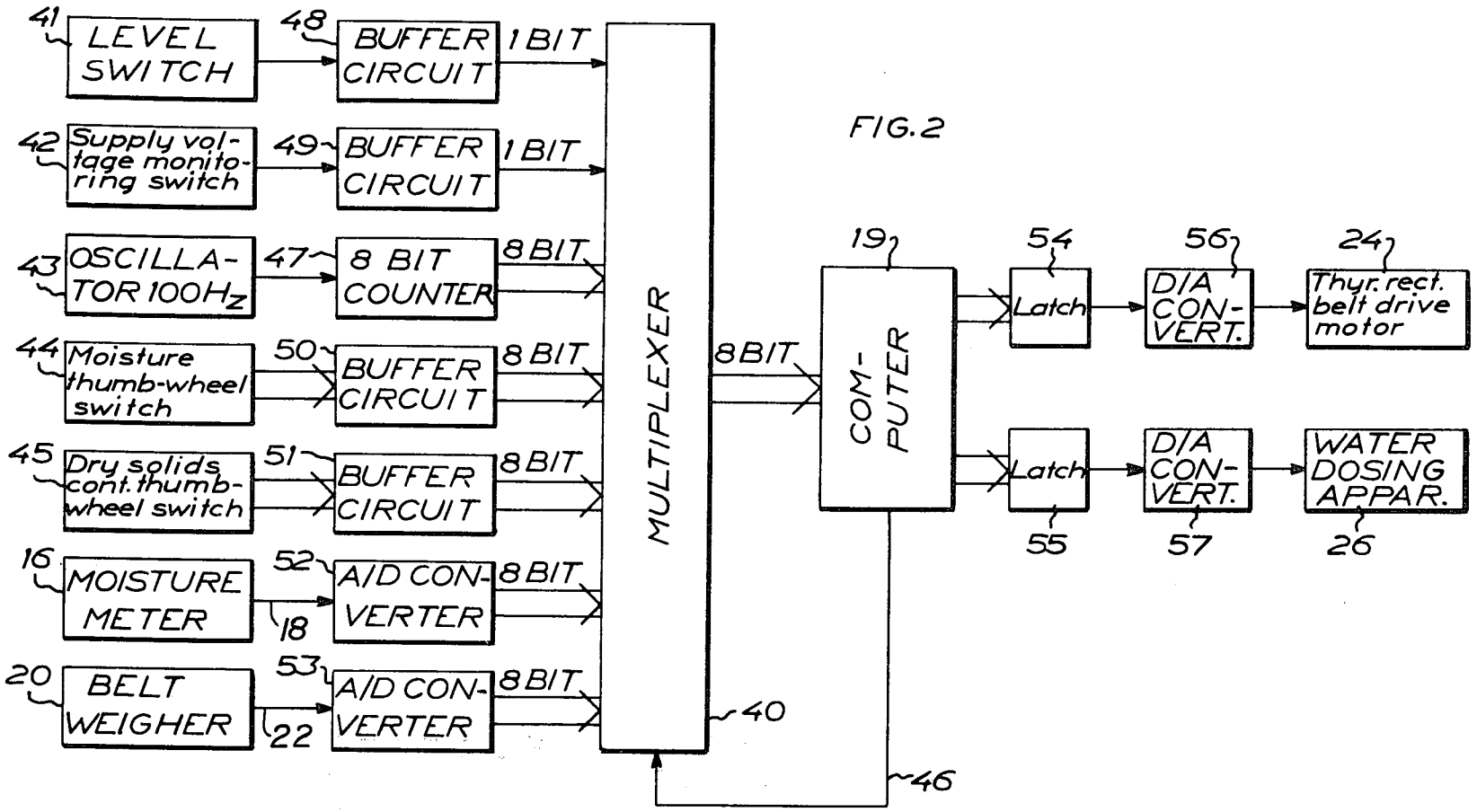
Figure 3A:
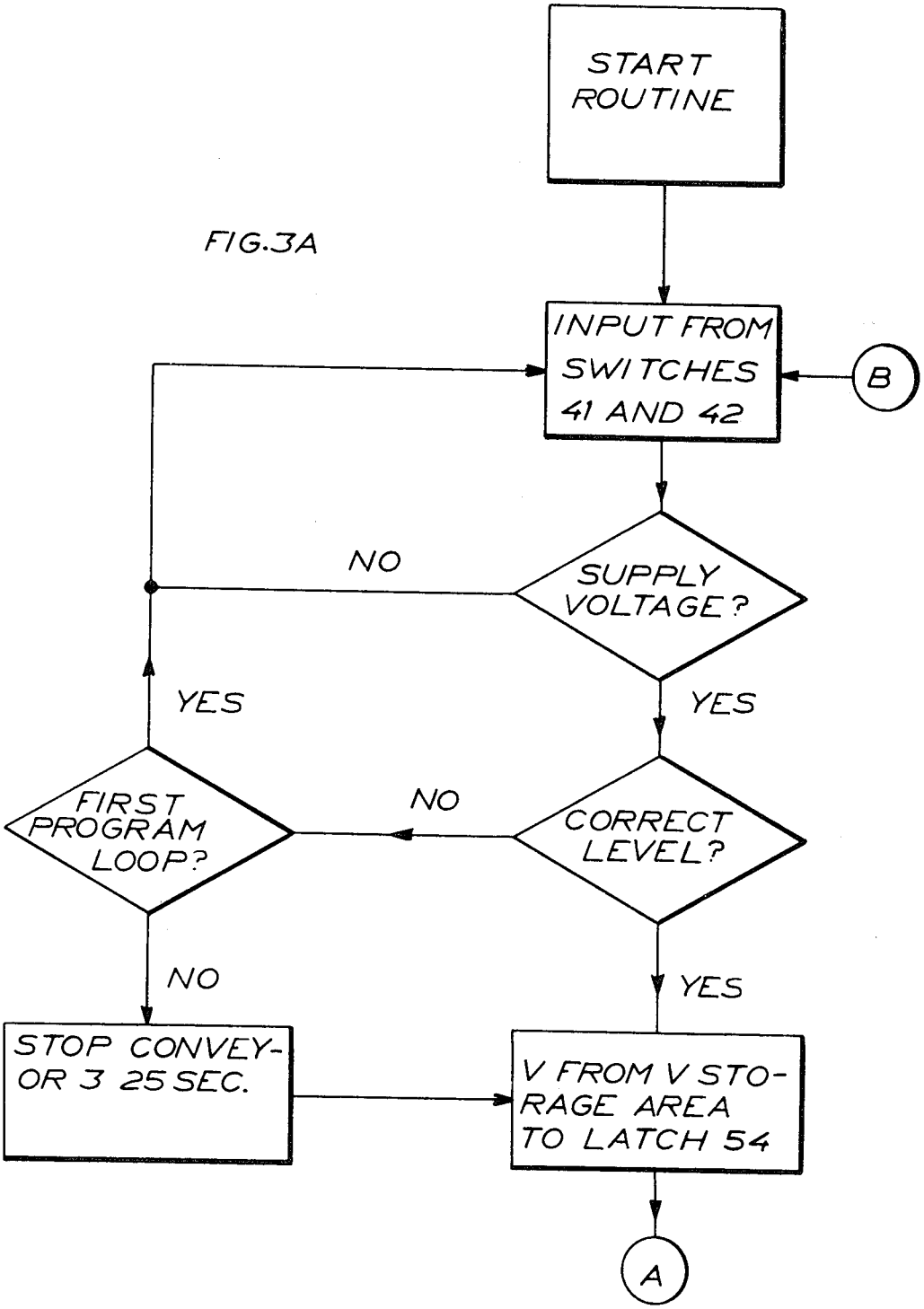
Figure 3B:
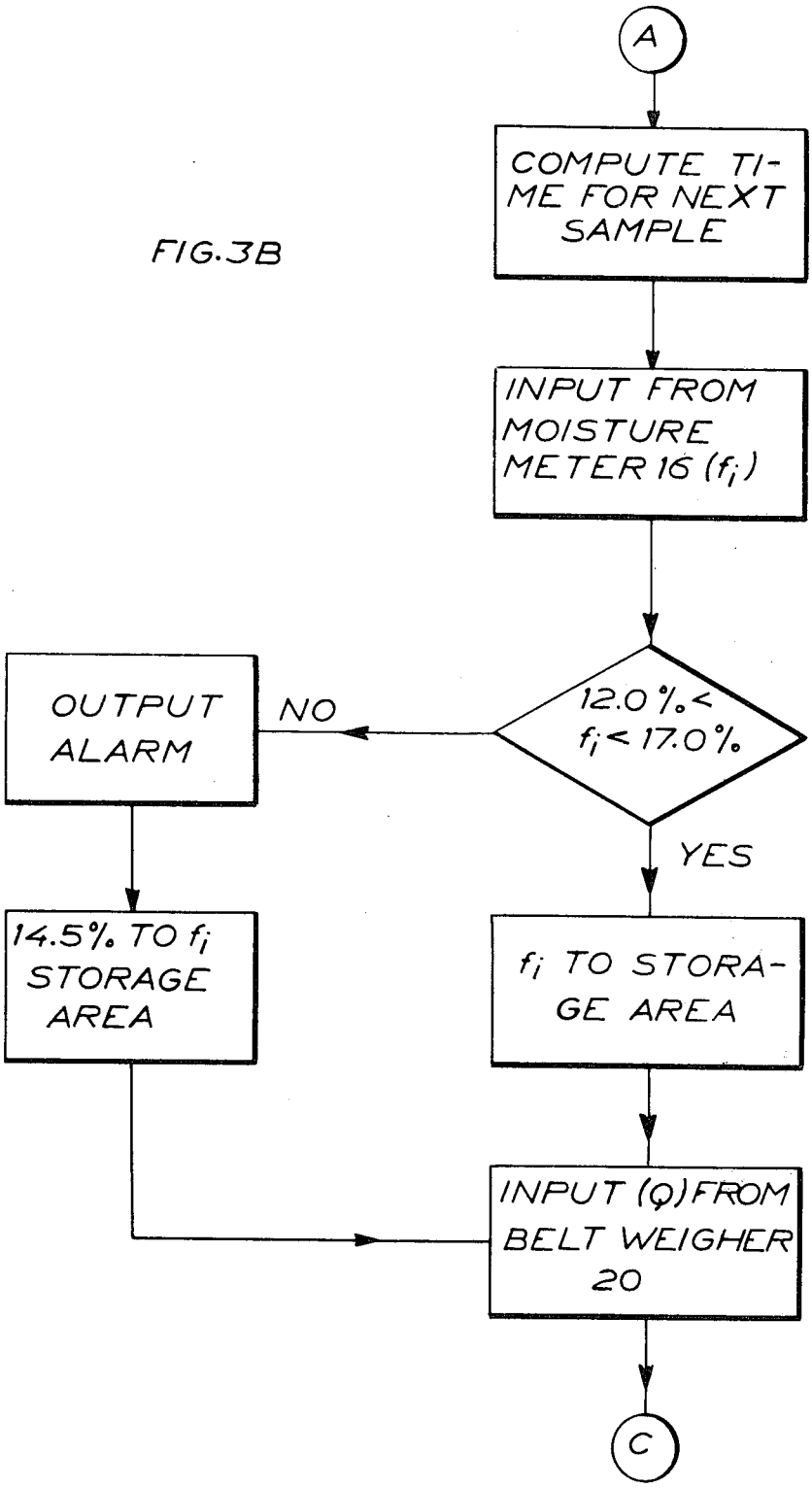
Figure 3C:
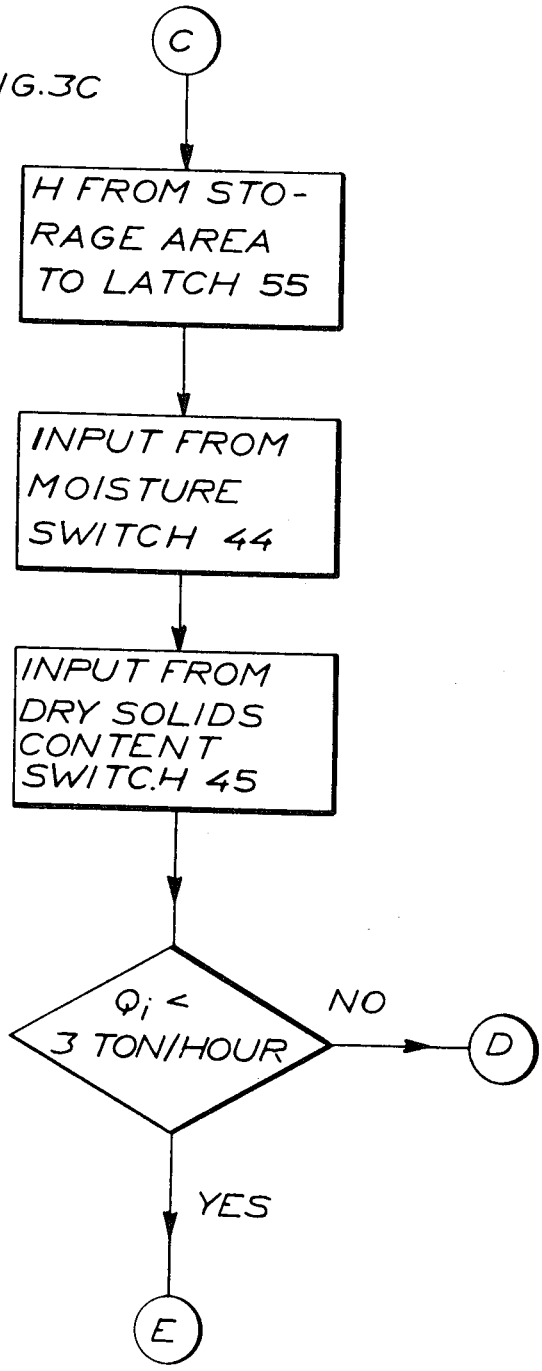
Figure 3D:
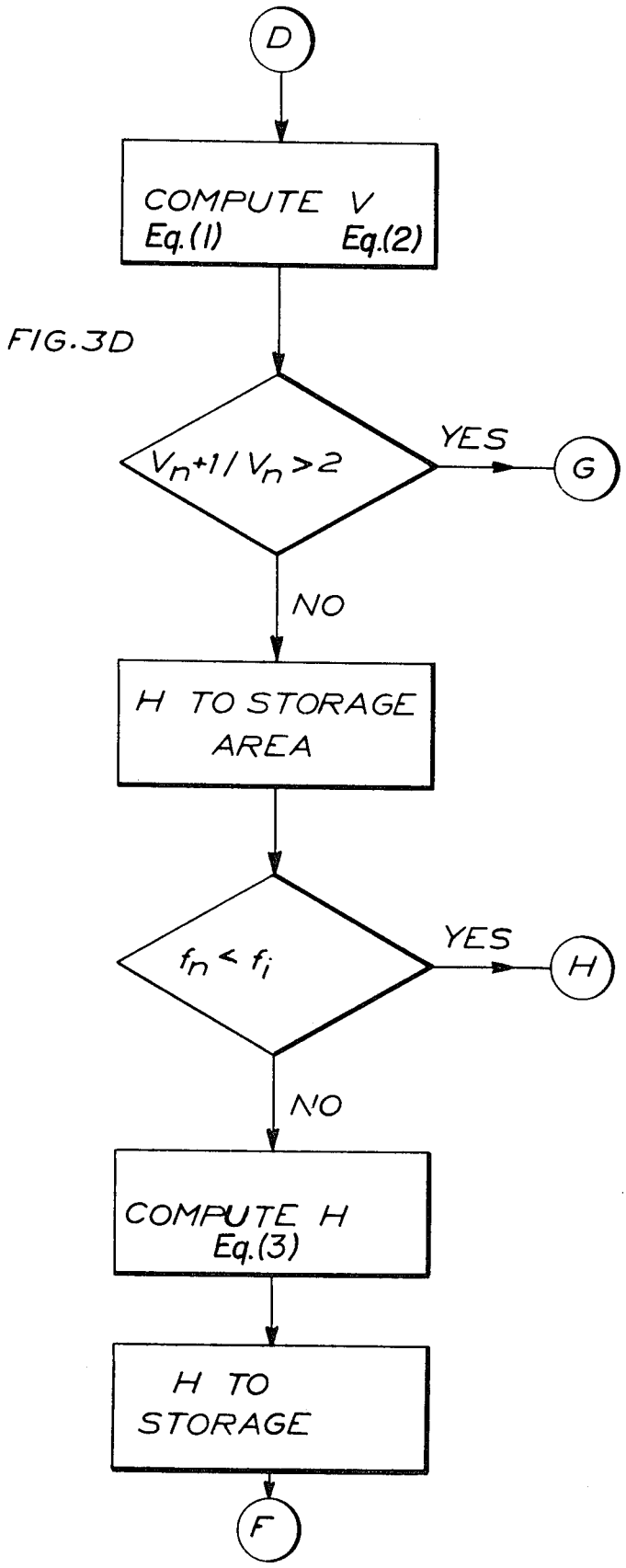
Figure 3E:
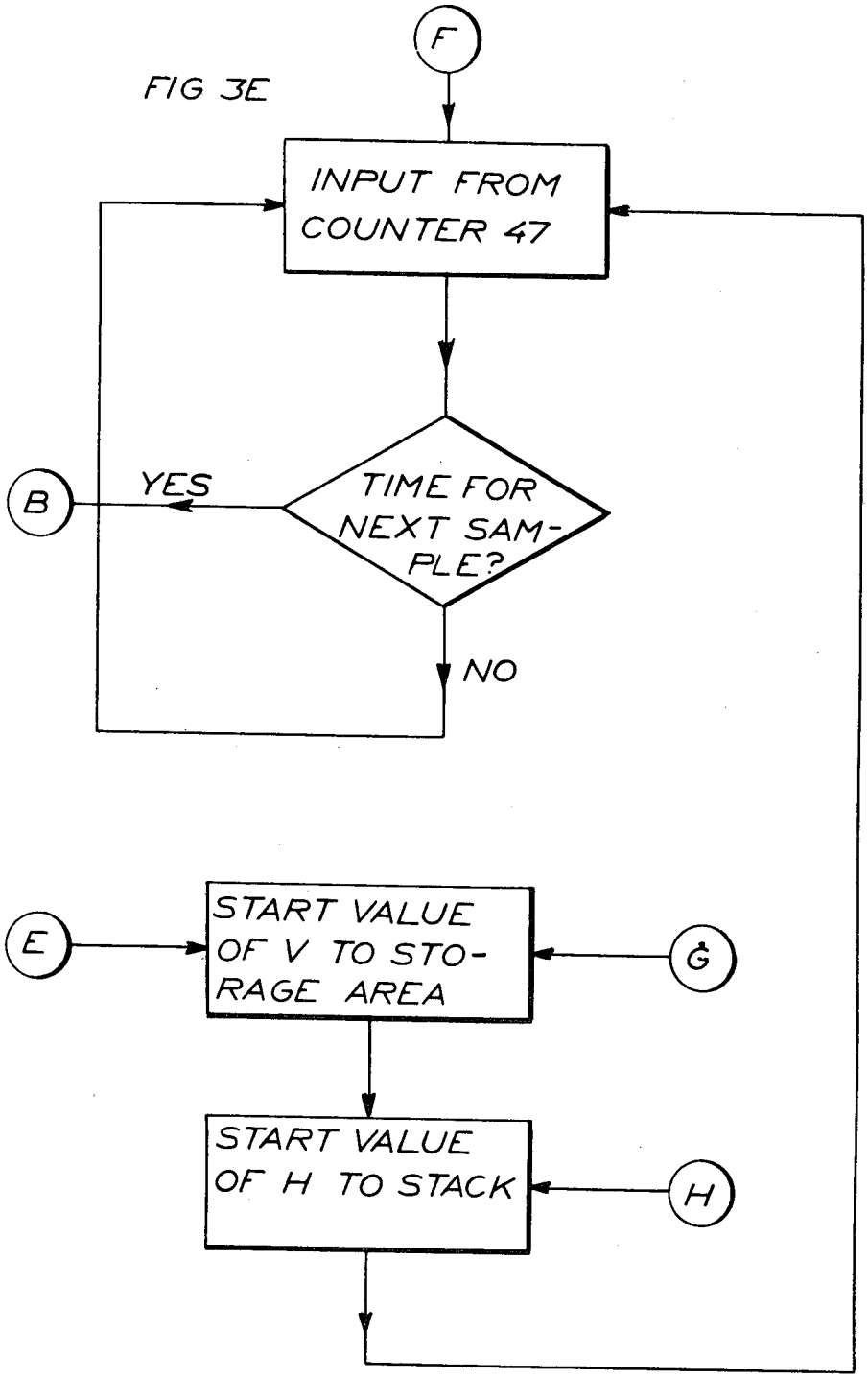

The invention will now be described in more detail in the following, reference being had to the accompanying drawing in which:

FIG. 1, by way of example, schematically illustrates a plant comprising an apparatus according to the invention for dosed moistening and saucing of a tobacco leaf mass;

FIG. 2 shows a block diagram of the control system;

FIGS. 3A to 3E together show a complete flow sheet illustrating the mode of operation of the control system.

The plant illustrated in FIG. 1 comprises a supply conveyor 1 on which a tobacco leaf mass can be conveyed continuously but, if desired, at a controllable rate to a supply device 2 of a type suitable for moisture metering and equipped with a moisture meter, for instance a vibrating chute from which the mass is transferred to a belt conveyor in the form of a so-called belt weigher 3. From the belt weigher 3, the mass is transferred via e.g. a vibrating conveyor 4 to a saucing station generally designated 5 from which the mass is discharged at 6 for use in the manufacture of tobacco products.

The saucing station 5 comprising a saucing drum of known design, comprising nozzles for the supply of sauce and moisture, for instance a sauce ejector 7 connected to a sauce conduit 8, a water ejector 9 connected to a water pipe 10, and a steam ejector 11 connected to a steam pipe 12.

The supply conveyor or chute 2 which, depending upon the type selected, may be operated by a suitable driving device 14, is equipped, in the embodiment illustrated, with insulating material 15 along a portion thereof, and in the region of this material 15 a moisture meter 16 is provided which continuously measures the moisture content of the mass supplied to the belt weigher 3 and which, via a line 17, transmits the measuring signal to an input 18 of a computer 19. The mass which is being advanced on the belt weigher 3, is weighed continuously by a scale 20 from which a weight signal is supplied through a line 21 to a second input 22 of the computer 19.

For the moisture meter 16, there may be used any known meter type suitable for the purpose here intended, for instance a moisture meter of the electronic type measuring the dielectric between two capacitor plates at opposing walls of the chute 2 or the wavelength of reflecting radiation (infrared moisture meter). Also the belt weigher 3 is well known within the art and had previously been used in the tobacco industry for measuring the throughflow weight of tobacco leaf mass.

It will appear from the above, that the computer 19 is connected to continuously receive moisture and weight measuring signals from two measuring points 16 and 3, respectively, located closely adjacent one another. As a practical result, which will be apparent from the following description of the complete flow sheet in FIGS. 3A to 3E, the computer can be said to be programmed for estimating, on the basis of these signals, the dry solids content of the mass and for comparing the actual value of said dry solids content of the mass transported on the belt weigher 3 with a preset desired value and, when a difference between this actual value and the preset value is sensed, to transmit speed control signals via a first signal output 19' to a line 23 for regulating a thyristor rectifier 24 connected to regulate a belt drive motor 6 for controlling the speed of the belt weigher 3 in dependence on these speed control signals to reset the actual value to the preset desired value of dry solids supplied to the saucing station 5. The computer is also programmed to compare the actual moisture content of the mass on the belt weigher with a preset desired value and to transmit a water addition control signal via a second output 19''and a line 25 to a dosing apparatus 26 to control the latter. This apparatus 26 is connected to a water supply pipe 10 for adjusting the water supply to a predetermined desired value of the moisture content of the output mass. To supplement this adjustment, or to replace it, the computer output signal to the line 25 may control a device, generally designated 27, for dosed supply of steam through the steam pipe 12. The device 27 may comprise a steam pressure indicator 28, a steam gauge 29, and a control valve 30.

As computer 19 use may be made of one of the several types of computers obtainable on the market as manufactured items, such as Microdator Type Nj 1 delivered by the Swedish company ELEKTRONLUND AB, MALMOE 1, Sweden. This or several other small computers may be used and programmed for the purpose described by any person skilled in the art.

Also the sauce supply through the sauce conduit 8 can be controlled by the computer via a control device 31, such as a thyristor rectifier, which, via an electric line 32, controls the operation of a pump 33, by controlling a pump motor 35, for sauce from a sauce tank 34 through the sauce conduit 8 to the sauce ejector 7.

It should, however, be observed that the water dosing apparatus 26 and the steam control device 27 may be arranged differently than has been described above. For instance, the device 31 may be set for a given sauce supply, and then the quotient sauce weight/dry weight of mass may be adjusted solely by controlling the belt weigher 3.

The input moisture content should be maintained lower than the desired output moisture content so that the moisture content may be corrected to the desired value by positive moisture addition, i.e. so that it will not be necessary to remove moisture in order to attain the preset desired value.

Naturally, the conveyors 1, 2, 3 and 4 illustrated in the drawing may be replaced by other equivalent devices, and naturally the moisture and weight measuring stations 2 and 3, respectively, may be positioned, according to circumstances, a shorter or longer distance from the processing station 5. Furthermore, it is pointed out that the apparatus according to the invention may be used for other applications than the control of a processing operation in the manufacture of tobacco.

According to the block diagram of the control system, shown in FIG. 2, the computer 19 (for instance Intel 8008) has its input connected to the output of a multiplexer 40 acting as interfacer (for example SN 74153, SN 74157) for receiving data from some of a plurality of input signal sources 16, 20, 41–45. In conformity with the program, the computer 19 controls via a control line 46 which one of these input signal sources that the multiplexer 40 shall connect to the computer 19.

The input signal sources comprise the moisture content meter 16 (shown in FIG. 1), the belt weigher 20 (likewise shown in FIG. 1), two BCD thumb-wheel switches 44 and 45 for manual presetting of the desired moisture content in percent and the desired dry solids weight in deciton per hour, an oscillator 43 which feeds an eight bit counter 47 (for instance SN 7493), a supply voltage monitoring switch 42 which monitors the supply voltage to the belt weigher motor, and a level switch 41 which monitors the level of the tobacco leaf mass in the supply conveyor 1.

For insulation and adaptation to the signal levels of the computer 19 the units 41 and 42 which deliver a two level signal are connected via buffer circuits 48 and 49, for instance Schmitt-triggers, each to one input of the multiplexer 40. The switches 44 and 45 are connected, via similar buffer circuits 50 and 51 which may consist of a plurality of Schmitt-triggers, each to one input of the multiplexer 40. Finally, the moisture meter 16 and the belt weigher 20 which deliver analog output signals are connected to the multiplexer 40 each via one analog - digital converter 52 and 53, respectively.

As a result of the data processing in the computer 19, effected in conformity with the program, said computer delivers a first digital output signal of eight bits to a latch 54 (for instance SN 7475, SN 7474), in which the output signal is stored as a control value for the speed of the belt conveyor 3, and a second digital output signal of eight bits to a latch 55 in which the output signal is stored as a control value for the water dosage. The value stored in the latch 54 is converted, more particularly by means of a digital-analog converter 56 into an analog signal which is supplied to the thyristor rectifier 24 for the motor of the belt conveyor 3 (see FIG. 1). In the same way the value stored in the latch 55 is converted into an analog signal which is supplied to the water dosage apparatus 26 for control of the amount of water added.

The mode of operation of the control system shown in FIG. 2 will clearly appear from the flow sheet in FIGS. 3A–E, for which reason no further explanation need be given.

However, mention may be made of the following. The program of the computer 19 comprises a start routine and a main program. The start routine is performed after impression of voltage or after initiation by actuation of a start button. The main program is performed with different time intervals during the control in dependence on the belt speed.

Control is effected as follows. It is assumed that the tobacco leaf mass is divided into samples of constant length. During the advance the computer establishes the positions of the different samples on the belt conveyor 3 on the basis of the known belt speed.

The length of the samples may be for instance 212 mm. The distance between the centre of the moisture meter 16 and that of the belt weigher may be 1905 mm, which corresponds to nine sample lengths. The distance between the centre of the belt weigher and the end of the belt conveyor 3 minus half a sample length may be 1061 mm, which corresponds to five sample lengths.

The moisture content $f_i$ of the tobacco leaf mass is measured in the supply device 2 and the measured value is stored by the computer 19 at the top of a memory area acting as a shift register and having nine memory cells. The lowermost value in the memory area thus is the moisture content of the sample which is positioned on the weigher. The moisture content of this sample is picked out by the computer and from this value, and from the dry solids value $Q_t$ from the thumb-wheel switch 45 the computer calculates the total weight $Q_b$ which is to be supplied:

$$Q_b = Q_t/(1 - f_i) \qquad \text{Eq. (1)}$$

From $Q_b$ and the prevailing belt speed $V_n$ the computer calculates the belt speed $V_{n+1}$ which is required for the supply of the correct total weight:

$$V_{n+1} = (Q_b/Q_i) \times V_n \qquad \text{Eq. (2)}$$

The belt speed is stored in a memory area acting as a shift register and having five memory cells. The lowermost value then corresponds to the sample situated at the end of the belt. In addition to the above calculations the computer also performs a calculation of the water addition H. For this calculation there is required the desired moisture content value $f_k$ from thumb-wheel switch 44:

$$H = Q_t \times (f_k/(1-f_k) - f_i/(1 - f_i) \qquad \text{Eq. (3)}$$

In the foregoing Equations (1), (2) and (3) the algebraic literal Equations are as follows:

$Q_b$ is the desired value of the total weight in units of weight per unit of time (usually tons/*h*);

$Q_i$ is the total weight (tons/*h*) conveyed at the belt speed $V_n$;

$Q_t$ is the desired solids weight (tons/*h*) set by means of the switch 45;

$f_i$ is the moisture content (%) of the total weight $Q_i$;

$f_k$ is the desired moisture content (%) of the total weight $Q_b$;

$V_n$ is the belt speed (mm/sec.) for conveying the total weight $Q_i$;

$V_n$— is the belt speed (mm/sec.) for conveyance of the desired value $Q_b$, that is the desired total weight, for attaining the desired moisture content $f_k$.

The calculated value of H is put into another memory area acting as a shift register and having five memory cells. The lowermost cell in the area then corresponds to the H-value of the sample which has reached the band end. The value at the bottom of said memory area then indicates the amount of water which is to be added, after a certain delay because of the vibratory conveyor 4, to the tobacco beneath the water nozzles in the saucing drum. The water pump is thus supplied with control signals at the same rate as the H-values were put into the memory area.

The computer performs the above course of calculation each time the conveyor belt has moved a sample length, i.e. 212 mm. At each new beginning of the main program the computer calculates, starting from the sample length of 212 mm and the current speed, the point of time when it shall begin the main program again. The oscillator 43 is utilised as a clock.

When the computer is started the start routine is first carried out. Starting values are here imparted to the above-mentioned memory areas. If there is tobacco on the belt conveyor 3 the control thereof will be calculated acc. to the starting values. The starting values may be 14.5 % for the moisture content, 0 l/min for the water addition, and 100 mm/sec for the advance speed of the belt conveyor 3.

The invention thus is not restricted to the above described embodiment but may be modified in different ways within the scope of the following claims.

I claim;

1. A method of controlling processing of a product mass conveyed by conveying means from one location to another, comprising the steps of measuring, at respective weight and moisture measurement points, the weight of said mass as the throughflow weight per unit of time and the actual value of the moisture content of the mass, and supplying set value inputs and signals related to said moisture and weight measurements to a computer to establish thereby in accordance with said supplied signals output signals representative of a predetermined value of dry solids which are to be delivered to said other location, and applying said output signals to means for controlling addition of moisture at a point downstream of said measurement points.

2. A method as claimed in claim 1, comprising the step of controlling the speed of said conveying means by said output signals representative of a predetermined value of dry solids derived from said computer for controlling the throughflow of said mass at a rate corresponding to said predetermined value of dry solids as throughflow dry weight of the mass conveyed per unit of time.

3. A method as claimed in claim 1, comprising the steps of automatically controlling a moistening device by said output signals representative of said required moisture addition derived from said computer for moistening the mass from the actual value to said desired value.

4. A method as claimed in claim 1, which further comprises the step of using at least one of said signals from said computer for metered incorporation of additional material in the mass to a predetermined value based upon the dry solids weight of the mass.

5. A method of evaluating and controlling a process of adding sauce in a saucing station to a tobacco leaf mass comprising the steps of conveying the mass by conveying means along a conveying path to said saucing station, measuring at respective weight and moisture measuring points positioned upstream of said saucing station the weight of the tobacco leaf mass as throughflow weight per unit of time and the actual value of moisture content of said mass continuously during transport of said mass along said path to said saucing station, transmitting set value inputs and signals related to said continuous weight and moisture measurings to a computer to establish thereby in accordance with said weight and moisture related signals, output signals usable to control said adding of sauce in said saucing station.

6. A method as claimed in claim 5, comprising the step of using the computer for adjusting the moisture content of the tobacco leaf mass to a desired value, by controlling a moisture adding means downstream of said measuring points.

7. A method as claimed in claim 5, comprising the step of controlling the speed of a conveyor for conveying the tobacco leaf mass to the saucing station.

8. A method as claimed in claim 5, comprising the steps of measuring the weight of the mass on a belt weigher, and using said computer to which the weight and moisture measuring signals are transmitted, for adjusting the speed of the belt weigher to a constant desired value of the dry weight of the mass.

9. An apparatus for measuring the actual value of the weight and the moisture content of a product mass during transport of said mass from one location to another, said apparatus comprising at least one conveyor for conveying the mass, a moisture meter for continuously measuring the magnitude of a parameter related to the moisture content as a measure of the moisture of the mass, a weigher in close proximity to said moisture meter for continuously measuring the weight of the mass, a computer, and means for transmitting moisture and weight measuring set inputs and signals to said computer to make the computer establish thereby, on the basis of said measuring signals control signals related to the dry weight of the mass as demand signals for supplying at a location downstream of said conveyor additional material into the mass to desired values of the mass.

10. An apparatus as claimed in claim 9, wherein said other location is a processing station located downstream of said conveyor and having means for adding sauce to the mass, and wherein said conveyor and the weigher are combined to constitute a per se known belt weigher having driving means and means for controlling said driving means; and means connecting said computer output means to said control means of the belt weigher for controlling the speed of said belt weigher to a speed for maintaining a constant desired value per unit of time of supplied mass dry weight to said processing station.

11. An apparatus as claimed in claim 9, wherein said conveyor and said weigher are combined to constitute a belt weigher having driving means and means for controlling said driving means thereby controlling the speed of the conveyor, and wherein said other location is a processing station located downstream of said conveyor and having means for adding moisture and sauce to the mass delivered to said station, and means connecting said computer output means to control said moisture and sauce adding means by said control signals.

* * * * *